United States Patent [19]

Vagin et al.

[11] 4,259,046

[45] Mar. 31, 1981

[54] APPARATUS FOR OBTAINING GRANULES FROM MELTS

[76] Inventors: Alexei A. Vagin, ulitsa Kljukvina, 6, kv. 18; Oleg J. Kornev, propsekt Dzerzhinskogo, 1, kv. 64; Alexandr I. Bednyakov, ulitsa Uritskogo, 10a, kv. 35, all of Dzerzhinsk, Gorkovskoi oblasti, U.S.S.R.

[21] Appl. No.: 73,375

[22] Filed: Sep. 7, 1979

[51] Int. Cl.[3] ..... B22F 9/00

[52] U.S. Cl. ..... 425/8

[58] Field of Search ..... 425/8

[56] References Cited

U.S. PATENT DOCUMENTS 3,298,058 1/1967 Summerville ..... 425/8

FOREIGN PATENT DOCUMENTS 499143 5/1930 Fed. Rep. of Germany ..... 425/8

*Primary Examiner*—Donald E. Czaja
*Assistant Examiner*—James R. Hall
*Attorney, Agent, or Firm*—Fleit & Jacobson

[57] ABSTRACT

The disclosed apparatus for obtaining granules from melts comprises a housing with perforated walls, mounted on a vertical shaft and accommodating therein annular baffles, a feeding device including a pipe for supplying the melt, and gates.

The feeding device of the apparatus is in the form of a chamber of which the section varies in the axial direction, the chamber accommodating therein a distributing tube extending coaxially with the chamber and having ports in the upper portion thereof. The gate of the apparatus is arranged intermediate the chamber and the feeding device for vertical adjustment. The feeding device includes one or more inclined deflectors extending at an angle relative to the axis of the distributing tube, the deflectors flaring in the direction toward the perforated walls of the housing, the latter defining jointly with the annular baffles surfaces which are concave relative to the axis of the housing.

The disclosed apparatus provides for obtaining granulometrically homogeneous product and enhances the uniformity of the spray density.

11 Claims, 4 Drawing Figures

APPARATUS FOR OBTAINING GRANULES FROM MELTS

The present invention relates to chemical machine-building, and more particularly it relates to apparatus for obtaining granules from melts.

The invention can be effectively utilized by the chemical industry in the manufacture of granulated mineral fertilizers including such widely employed ones as ammonium nitrate and carbamide.

The invention can be also utilized by the medicine-making, pharmaceutical, food and other industries.

There is known a centrifugal apparatus for making granules from molten substances, comprising a hollow perforated housing rotatably mounted on a shaft and having secured thereto a lid with a central opening. Mounted on the shaft are trapezoidal ribs dividing the housing into compartments, the ribs clearing the internal surface of the housing.

This apparatus operates, as follows.

The apparatus for obtaining granules from melts is arranged centrally of the top portion of a granulation tower which is a permanent structure of either reinforced concrete or brick, having a diameter of about 16 meters and a height within 30 to 40 or more meters, the tower having at the bottom thereof an inlet for the cooling air, and at the top thereof an outlet therefor. The apparatus is rotated about a vertical shaft by a drive.

The molten substance to be granulated is supplied through the central opening in the lid and spreads through the compartments of the apparatus wherefrom the centrifugal force and hydrostatic pressure drive it through the perforations in the housing in thin jets breaking up into droplets, as they fall within the granulation tower. Owing to the supply into the arrangement of a countercurrent of cooling air, the droplets of the melt solidify into spherical granules.

However the abovedescribed known apparatus for making granules from melts does not ensure the production of a granulometrically homogeneous product; neither does it ensure the uniform density of the spray cross-sectionally of the granulation tower, which hampers intensification of the granulation process, on account of the inadequate degree of utilization of the granulation tower volume and of the cooling air.

The granulometric composition of the product turned out by the abovedescribed known apparatus depends on the supply rate of the melt thereinto. Thus, with the melt being supplied into the apparatus at a rate approximating its maximum throughput value, the size of the obtained granules increases, whereas with the supply rate being low, small substandard granules are obtained of which some are carried away by the cooling air and are wasted, which is not uncommon in industrial production of mineral fertilizers. If the velocity of the cooling air in the granulation tower is stepped up to intensify the granulating process, the non-uniform granulometric composition of the obtained product involves intolerably high losses. Therefore, the employment of the abovedescribed known apparatus in applications where the supply rate has a tendency to vary within a considerable range does not ensure the output of high-quality granulated product and hampers the possibility of intensifying the process of granulation, as a whole.

The cause of the output of small substandard granules is in that with a low rate of the supply of the melt into the apparatus, there is formed on the inner surface of the hollow perforated housing a layer of the melt, which is insufficient for maintaining an optimum duty of ejection of the jets of the melt through the perforations in the housing. This is accompanied by considerable turbulence of the flow of the melt adjacent to the perforations of the housing, of which some become completely bare of the melt, and also by some of the air being taken up by the melt, which results in fine atomization of the melt, the said phenomena resulting in obtaining substandard granulated product.

Characteristic of the abovedescribed known apparatus is that the spray of the melt cross-sectionally of the granulation tower predominantly concentrates in a relatively narrow ring, the density of the spray depending on the supply rate of the melt into the apparatus and being uncontrollable per se.

Therefore, the volume of the granulation tower where the granulated product is cooled is not utilized to the utmost capacity, which also hampers the possibility of intensifying the granulation process. p Attempts have been made to enhance the uniformity of the spray cross-sectionally of the granulation tower, which attempts are reflected in an apparatus for granulating molten substances, comprising a rotatable perforated housing of an elliptical cross-section.

This known apparatus for granulating molten substances operates, as follows.

The apparatus for granulating molten substances is mounted in the top portion of a granulation tower.

The substance to be granulated is introduced into the rotating perforated housing of the apparatus via the supply pipe, and is ejected therefrom in jets through the perforations, these jets subsequently breaking up into droplets solidifying the granules as they fall within the granulation tower, owing to their being cooled by the counter-current of the cooling air.

With the cross-section of the housing of the apparatus being elliptical, there is attained better uniformity of the spray cross-sectionally of the granulation tower, which provides for fuller utilization of the working space of this tower.

However, this apparatus has been found to turn out unhomogeneous final product, on account of the portions of the perforated housing's inner surface at the smaller radii of rotation becoming partly bare in operation of the apparatus, and also on account of the air being partly taken up by the melt, and on account of the formation of considerable tangentially directed flows of the melt within the housing of the apparatus, which flows increase the turbulence in the layers of the melt at the perforations of the housing and thus affect the stability of ejection of jets through the perforations.

There is a further known from U.S. Pat. No. 3,298,058 an apparatus for forming droplets of melts, which we consider the closest prior art of the present invention, comprising a rotatable cylindrical housing of which the wall has a plurality of openings made therethrough, the wall being made integral with horizontal annular baffles. Rigidly secured longitudinally of the wall in the top portion of the housing are flat vertical partitions or baffles. The melt is supplied into the apparatus by a feeding device including a disc and supply pipes.

The last-mentioned apparatus for forming droplets of melts operates, as follows.

A melt of the matter to be granulated is supplied into the feeding device via the supply pipes upon the disc mounted on the shaft, wherefrom it is thrown by the centrifugal force into the space between the upper wall of the housing and the horizontal annular baffle, toward the walls of the housing, wherein the melt is accelerated to the angular speed equalling the speed of rotation of the housing and overflows the annular baffles into the underlying spaces between the successive annular baffles. The melt is subsequently ejected through the openings in the wall of the housing in jets which break up into droplets cooling into granules.

However, this apparatus does not provide for obtaining granules of homogeneous granulometric composition, particularly, when the supply rate thereinto of the product to be granulated varies. This is caused by the fact that in this apparatus of the prior art the feed of the melt into the spaces between the horizontal annular baffles, performed by the disc, is uncontrollable, whereby, at certain feed rates of the melt into the apparatus, the bottommost of the spaces supplied with the melt would receive it in quantities insufficient for forming on the inner surface of the housing wall a melt layer providing for stable ejection of the jets, which stability is essential for obtaining final product of uniform granulometric composition.

Moreover, the melt spray cross-sectionally of the granulation tower, produced by the apparatus, is not uniform. With the apparatus of the prior art opening, the spray cross-sectionally of the granulation tower predominantly concentrates in a relatively narrow ring, so that the central area of the granulation tower and the peripheral zones thereof are relatively relieved of the production load, which means that the volume of the granulation tower and the cooling capacity of the air are not utilized in full, and this affects the efficiency of the granulation process.

It is the main object of the present invention to create an apparatus for obtaining granules from melts, wherein a feeding device and a gate are constructed and relatively arranged to provide for obtaining final product of essentially homogeneous granulometric composition.

It is a not less important object of the present invention to create an apparatus for obtaining granules from melt, wherein a feeding device and a gate are constructed and relatively arranged to provide for enhancing the uniformity of the spray cross-sectionally of the granulation tower and thus to step up the efficiency of the granulation process, as a whole.

These and other objects are attained in an apparatus for obtaining granules from melts, comprising a housing mounted on a vertical shaft and having perforated walls, annular baffles secured internally of the housing on the perforated walls and a feeding device with a melt supply pipe, arranged coaxially with the housing, in which apparatus, in accordance with the invention, the feeding device includes a chamber having its section varying axially of this chamber, the latter coaxially accommodating therein a distributing tube with ports in the upper portion thereof, the bottom end face of this tube being arranged adjacent to the end face of one of the annular baffles, and a gate arranged intermediate the chamber and the distributing tube for vertical adjustment.

An apparatus constructed in accordance with the invention provides for producing granulated mineral fertilizers of essentially homogeneous granulometric composition and ensures a levelled-out density of the spray cross-sectionally of the granulation tower. This is attained owing to controllable filling of the sections of the housing of the apparatus with the melt, whereby the quantity of the melt fed into these sections can be maintained within the optimum range essential both for obtaining high-quality granulated product and for producing a uniform spray cross-sectionally of the granulation tower.

It is expedient that the feeding device should include additionally at least one deflector for the melt, extending at an angle to the axis of the distributing tube.

It is further expedient that the deflectors for the melt should be mounted on the distributing tube, in a number defined by that of the annular baffles.

It is still further expedient that the deflectors for the melt should be mounted on the shaft, in a number defined by that of the annular baffles.

It is also expedient that the inclined deflectors for the melt should be flaring toward the perforated wall of the housing, the latter defining jointly with the annular baffles a plurality of surfaces which are concave with respect to the axis of the housing.

The disclosed construction of the annular baffles and of the top part of the apparatus in combination with the deflectors for the melt results in the creation of shaped annular ducts via which the melt is supplied to the perforated walls of the housing, thus providing for successive controllable filling of the sections of the apparatus with the melt and inhibiting turbulence of the melt flow, which enhances the quality of the final granulated product obtained.

Given hereinbelow is a description of an embodiment of the invention, with reference being had to the accompanying drawings, wherein:

FIG. 1 schematically illustrates a sectional view of the apparatus, with the gate in the central position;

Figure 1:
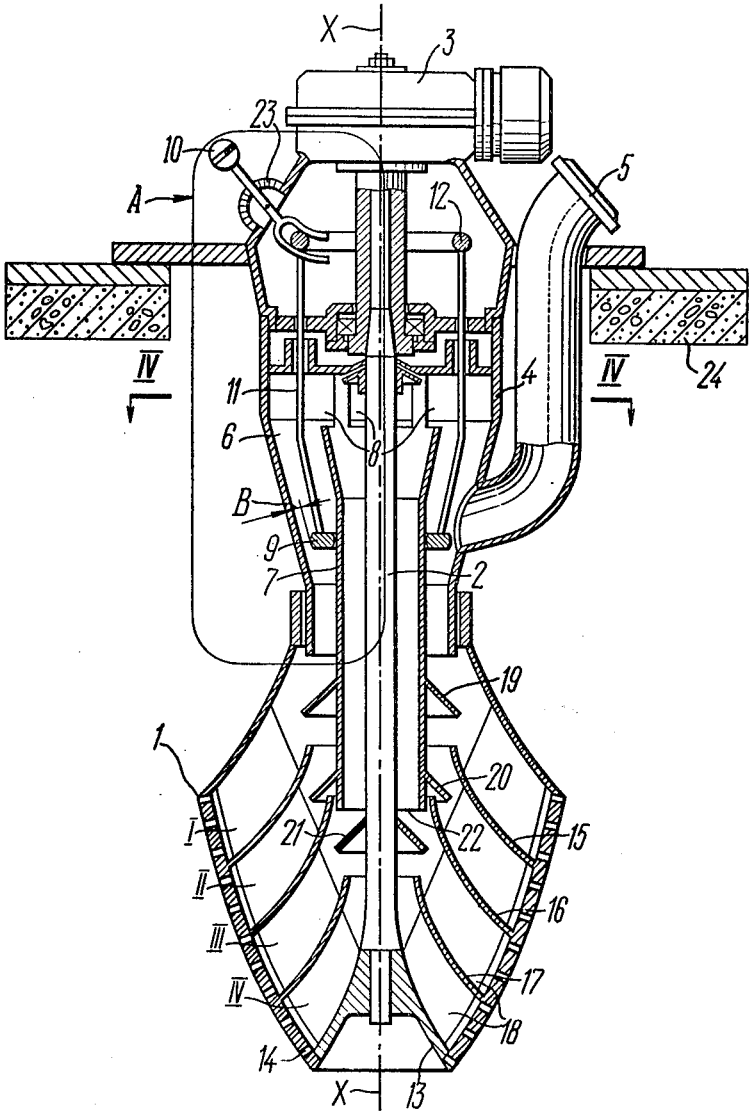

In the drawings, the apparatus for obtaining granules from melt, embodying the present invention, comprises a housing 1 (FIG. 1) mounted on a vertical shaft 2 rotatable by a drive 3, a feeding device 4 with a melt supply pipe 5, the device 4 including a chamber 6 of which the section varies axially of the chamber, and a distributing tube 7 arranged coaxially with the axis X—X of chamber 6 and having ports 8 in the upper portion thereof. The housing 1, vertical shaft 2, chamber 6, and distributing tube 7 are coaxial with each other. Mounted intermediate the chamber 6 and the distributing tube 7 is a gate 9 which is vertically adjustable with a lever 10 through actuators 11 in the form of push-rods interconnected by a ring 12.

The housing 1 includes a hub 13 supporting a perforated wall 14 having secured thereto annular baffles 15, 16 and 17 defining with the upper portion of the housing and with the hub 13 a vertical series of sections I, II, III and IV.

The annular baffles 15, 16, 17, the top of the housing 1 and the surface of the hub 13, facing the interior of the housing 1, are all concave with respect to the axis of the apparatus and have ribs 18 secured thereon.

The distributing tube 7 at the bottom portion thereof and the shaft 2 have deflectors 19, 20, 21 secured thereon, extending at an angle to the axis of the apparatus and flaring toward the perforated wall 14 of the housing 1, the bottom end face 22 of the distributing tube 7 being arranged adjacent to the face end of one of the annular baffles 15, 16 and 17 of the housing 1 of the apparatus.

A dial 23 is mounted on the housing of the drive 3 to monitor the position of the lever 10 controlling the gate 9.

The apparatus for obtaining granules from melts, embodying the present invention, operates as follows.

The apparatus for obtaining granules from melts is mounted centrally of the roof of a granulation tower 24.

The drive 3 is energized to rotate the housing 1 about the axis X—X thereof through the shaft 2. A melt of the product to be granulated is introduced into the feeding device 4 via the supply pipe 5. From the space between the chamber 6 and the distributing tube 7 the melt flows via the annular clearance B (FIG. 1) defined by the inner surface of the chamber 6 and the gate 9 into the section I of the housing 1 of the apparatus, defined by the upper portion of the housing 1 and the annular baffle 15. Within this section I the melt is accelerated to an angular speed substantially equalling the angular speed of rotation of the housing 1, owing to the ribs 18 opposing the slip of the melt relative to the housing 1.

The melt issues in jets through the perforations of the wall 14 of the section I. As the jets of the melt advance in the space of the granulation tower 24, they break up into droplets which are cooled by the counter-current of air into solid spherical granules. If the supply rate of the melt into the apparatus is increased with the gate 9 in the raised position (FIG. 3), the melt fills up completely the section I and overflows into the section II defined by the baffles 15 and 16, over the end face of the baffle 15, whereafter it issues in jets through the perforations in the wall 14 of the last-mentioned section II. With the section I not filled completely, the input of the melt into the section II is inhibited by the deflector 19 for the melt, which deflects the melt toward the section I.

It has been already mentioned that the duty of ejection of the melt through the perforations of the perforated wall 14 of the housing 1 determines the quality of the finally obtained granulated product.

The stable optimum duty of ejection of the melt through the perforated wall 14 of the housing 1 within each successive section I, II, III and IV is ensured when the turbulence of the melt adjacent to the perforated wall 14 is minimal, owing to the sufficient thickness of the melt layers within these sections I, II, III and IV, and when the air is precluded from being taken up by the issuing melt which otherwise would result in atomization of the melt and eventual production of fine, non-uniform granules.

The thickness of the melt layer at the perforated wall 14 of the housing 1 within each section I, II, III and IV depends on the supply rate of the melt thereinto. The greater the feed rate of the melt into the sections I, II, III and IV of the apparatus, the thicker are the melt layers at the respective perforated wall 14 of these sections, and vice versa, the less melt is supplied into either one of the sections I, II, III and IV of the apparatus, the thinner is the melt layer at the perforated wall 14 of this section.

The amount of the melt supplied into each section I, II, III or IV of the apparatus should not be short of the value which is quite specific for each one of the sections and corresponds to the creation therein of the minimum permissible thickness of the melt layer at the perforated wall 14 within this section, providing for the required duty of ejection of the melt through the perforations in this wall 14 and for obtaining granulometrically homogeneous final product.

The supply of the required amount of the melt into each operating one of the sections I, II, III and IV of the housing 1 of the apparatus is maintained with the aid of the gate 9 which is adjustable with the lever 10 to either increase or reduce the value of the clearance B.

Figure 2:
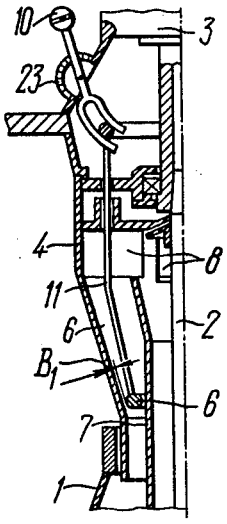
FIG. 2 illustrates schematically the area "A" of FIG. 1, with the gate adjusted into its lowered position.
Figure 3:
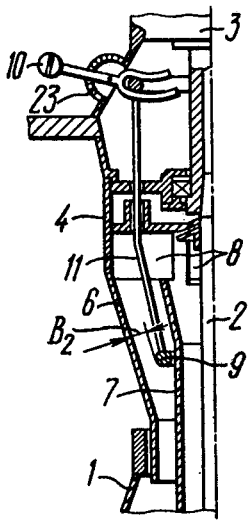
FIG. 3 illustrates schematically the area "A" of FIG. 1, with the gate adjusted into its raised position.
Figure 4:
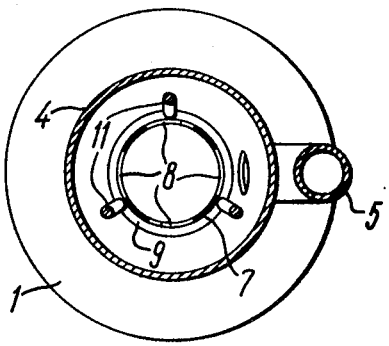
FIG. 4 is a cross-sectional view taken on line IV—IV of FIG. 1.

In FIG. 1 the gate 9 is shown in its central position, in FIG. 2—in the lowered one, and in FIG. 3—in the raised one. By comparing the positions occupied by the gate 9 in FIGS. 1, 2 and 3, it can be seen that the clearance B between the gate 9 and the wall of the chamber 6 of the feeding device 4, shown in FIG. 1, has a medium value, whereas the clearance $B_1$ shown in FIG. 2 is smaller than this medium value, and the clearance $B_2$ shown in FIG. 3 is greater than this medium value. Correspondingly, the amount of the melt flowing through the clearance $B_1$ would be of a relatively small value, through the clearance $B_2$—of a relatively great value, and through the clearance B—of a medium value.

With the gate 9 set to the position illustrated in FIG. 2, with the clearance $B_1$ being at the minimum, the amount of the melt supplied into the section I decreases, with the corresponding reduction of the amount of the melt that is superfluous for the section I and thus overflows into the section II.

Depending on the value of the clearance $B_1$, the overflow of the melt from the section I into the section II may be cut off altogether, and thus the section II would be cut out from the operation.

With the value of the clearance B being relatively small, and the supply rate of the melt into the apparatus being sufficiently great, so that the entire feed of the melt into the apparatus is unable to flow through the limited clearance B, the superfluous melt would fill the space between the chamber 6 of the feeding device 4 and the distributing tube 7, up to the level of the ports 8 of this distributing tube 7, and thus would overflow into the distributing tube 7. From the internal space of the distributing tube 7 the melt would flow into the section III defined by the annular baffles 16 and 17, and would issue through the perforation of the perforated wall 14 of this section. If the supply rate of the melt into the apparatus is sufficient for filling up in this manner the entire section III of the apparatus, the melt would overflow over the edge of the annular baffle 17 into the section IV defined by the annular baffle 17 and the hub 13, to be ejected through the perforations in the perforated wall 14 of the last-mentioned section IV. The deflector 21 for the melt ensures its supply first to the section III wherefrom the melt flows then to the section IV. By adjusting the position of the gate 9 by shifting the lever 10 along the dial 23 in accordance with the supply rate of the melt into the apparatus, there is adjusted the feed rate of the melt into the sections I,II,III and IV of the apparatus, so as to prevent the creation at the perforated wall 14 within either one of the sections I,II,III and IV of an insufficiently thick layer of the melt. Depending on the supply rate of the melt into the apparatus, it is possible to direct it either exclusively into the section I into which it is fed in any case, or else at the same time into either some or all of the sections II,III and IV of the housing 1 of the apparatus.

The lever 10 is set against the dial 23 calibrated by the values of the supply rate of the melt into the apparatus, so that throughout the range of the supply rates the position of the lever 10, and, hence, the values of the clearance B between the gate 9 and the chamber 6 of the feeding device 4 should provide for the abovedescribed required feed of the melt into the sections I, II, III and IV of the housing 1 of the apparatus.

In operation of the apparatus, each one of its sections I, II, III and IV produces its own circle of spray cross-sectionally of the granulation tower 24, with the maximum density of this spray concentrated within a ring. The dimensions of the rings of the maximum spray density, produced by the respective sections I, II, III and IV of the housing 1 of the apparatus, are different, owing to these dimensions being determined, firstly, by the respective diameter of the perforated wall 14 of the housing 1 within each section I, II, III and IV, and, secondly, by the thicknesses of the melt layer at the respective areas of the perforated wall 14 within these sections I, II, III and IV.

The greater the diameters of the perforated wall 14 and the thicknesses of the melt layer within the respective sections I, II, III and IV of the housing 1 of the apparatus, the greater are the diameters of the rings of the maximum spray density, and vice versa, the smaller the diameters of the perforated wall 14 of the housing 1 and the thinner the melt layers within the sections I, II, III and IV, the smaller the diameters of the rings of the maximum spray density will be. The diameters of the perforated wall 14 of the housing 1 are different within the sections I, II, III and IV of the apparatus, the diameter within the section I being the greatest, and those within the sections II, III and IV being successively smaller. Correspondingly, the maximum thicknesses of the melt layer that can be created within the sections I, II, III and IV of the apparatus are likewise different, the greatest maximum thickness being that within the section I, and those within the sections II, III and IV being successively smaller. Therefore, the section I produces the ring of the maximum spray density of the greatest diameter, and the sections II, III and IV are capable of producing such rings of the successively decreasing diameters.

The degree of the filling of the sections I, II, III and IV of the apparatus with the melt is adjusted by the gate 9 with the aid of the lever 10. It has been found expedient that with the minimum and medium working load of the apparatus the melt should be fed into the sections I and III, and with the working load at the maximum, the melt should be fed into all the sections I, II, III and IV proportionally to their throughput. In this way it is relatively easy to ensure the optimally levelled out density of the spray cross-sectionally of the granulation tower, produced by the apparatus.

The levelled out density of the spray cross-sectionally of the granulation tower provides for efficient utilization of the cooling air and is a prerequisite for intensification of the granulation process, as a whole.

The concave shapes, relative to the axis of the housing 1 of the apparatus, of the annular baffles 15, 16 and 17, of the upper portion of the housing 1 and of the hub 13 enhance smooth delivery of the melt to the openings in the perforated wall 14 of the housing 1 of the apparatus, with minimized turbulence. Owing to the minimized turbulence of the melt within the sections I, II, III and IV of the housing 1 of the apparatus, there is stabilized the duty of ejection of the melt through the perforated wall 14, which yields more uniform droplets and enhances the quality of the final granulated product.

In other embodiments of the apparatus in accordance with the invention the number of the sections may be two or more, depending on the properties of the product to be granulated, its required final granulometric composition, the capacity of the apparatus and other factors. An apparatus for obtaining granules from melts, having two sections, would differ from the embodiment with the four sections, illustrated schematically in FIG. 1, in that it would be devoid of the annular baffles 15 and 17, and of the deflectors 19 and 21 for the melt. An apparatus for obtaining granules from melts in accordance with the present invention, having six sections, would differ from the apparatus with the four sections, illustrated in FIG. 1 and described hereinabove, in that it would incorporate, intermediate the upper portion of the housing 1 and the baffle 16, in addition to the annular baffle 15, one more annular baffle, and intermediate the hub 13 and the annular baffle 16, in addition to the annular baffle 17, still one more annular baffle.

In the last-described embodiment, there should be further mounted on the distributing tube 7 and on the shaft 2, one additional deflector for the melt above each one of the two additional annular baffles, similar to the deflectors 19 and 21 for the melt, to provide for the successive downward feed of the melt throughout the apparatus.

An embodiment of the apparatus in accordance with the present invention may have no deflectors 19 and 21 for the melt. In this case differential filling of the sections of the housing 1 of the apparatus should be provided for not only by adjusting the gate 9 by shifting the lever 10 along the dial 23, but also by selecting the appropriate ratios of the diameters of the outlets of the chamber 6 of the feeding device 4, of the distributing tube 7 and of the diameters of the end faces of the annular baffles.

What is claimed is:

1. An apparatus for use with a granulation tower for obtaining granules from melts, the apparatus being mounted in the tower in such manner that granules leaving the apparatus fall downwardly within the tower, comprising:

a vertical shaft rotatably supported by the tower;

a housing mounted for rotation on the vertical shaft and having perforated side walls;

annular baffles mounted internally of said housing on said perforated walls for dividing said housing into a plurality of vertically-spaced sections;

a melt supply pipe for supplying melt to said housing;

a feeding device positioned between said housing and said melt supply pipe for receiving melt from said supply pipe and for feeding melt to said housing, said feeding device including a chamber having its section varying axially thereof and decreasing in a downward direction;

a distributing tube accommodated within said chamber coaxially therewith and having a bottom end face arranged adjacent to an end face of one of said annular baffles;

ports made in an upper portion of said distributing tube so that melt above a predetermined level in said chamber flows into said distributing tube;

a gate mounted for vertical adjustment intermediate said chamber and said distributing tube so that the rate of flow of melt past said gate into said housing is adjustable; and means for rotating said vertical shaft so that said housing is rotated creating centrifugal forces forcing melt fed to said housing outwardly through the perforated side walls of said housing thereby forming granules that are cooled within the granulation tower.

2. The apparatus of claim 1, wherein said feeding device additionally includes at least one deflector for the melt, extending at an angle relative to the axis of said distributing tube so that melt is deflected into an upper one of said sections and fills the upper one to a predetermined level before flowing into a lower one of said sections.

3. The apparatus of claim 2, wherein a plurality of deflectors for the melt are mounted on said distributing tube, their number being determined by the number of said annular baffles.

4. The apparatus of claim 2, wherein at least one inclined deflector for the melt is mounted on said shaft, the number of deflectors being determined by that of said annular baffles.

5. The apparatus of claim 2, wherein at least one deflector for the melt flares towards said perforated walls of said housing, the latter defining jointly with the upper portion thereof and with said annular baffles a plurality of surfaces which are concave with respect to the axis of said housing.

6. An apparatus for use with a granulation tower for obtaining granules from melts, comprising:

a feeding device mountable in a portion of a granulation tower, said feeding device having a chamber with a cross-section that decreases in a downward direction;

a vertical shaft rotatably supported by the tower and extending through said feeding device and having a lower portion located beneath said feeding device;

a housing mounted for rotation on the lower portion of said vertical shaft, the housing having perforated side walls and being in fluid communication with said feeding device;

a plurality of annular baffles mounted on and extending upwardly and inwardly from the side walls of said housing to define a plurality of vertically spaced sections within said housing;

a melt supply pipe in fluid communication with said feeding device for supplying melt to said chamber of said feeding device, melt received in said chamber being fed to said housing;

a distributing tube accommodated within said chamber and extending from an upper portion of said chamber to a level below the annular baffle defining an uppermost of said sections defined within said housing so that melt flows from the upper portion of said chamber through said distributing tube into a lower one of said sections;

a vertically adjustable gate positioned in said chamber for controlling the rate of flow of melt past said gate into said housing; and means for rotating said vertical shaft so that said housing rotates whereby centrifugal forces created by such rotation force melt outwardly through the perforated walls of said housing to thereby form granules that are cooled within the granulation tower.

7. The apparatus of claim 6, further comprising a deflector positioned lower than said gate for deflecting melt into the uppermost of said sections so that melt flowing past said gate flows first into the uppermost section.

8. The apparatus of claim 6 or 7, wherein said gate is movable into a position in which melt simultaneously flows past said gate into the uppermost of said sections and flows through said distributing tube into the lower one of said sections.

9. The apparatus of claim 8, further comprising a deflector positioned below the lower end of said distributing tube for deflecting melt into the lower one of said sections.

10. The apparatus of claim 6, further comprising at least one deflector positioned lower than said gate for deflecting melt into said sections, the number of deflectors being one less than the number of sections.

11. The apparatus of claim 6, wherein the gate is movable between a first position in which a minimum amount of melt flows past said gate into said housing, a second position in which a maximum amount of melt flows past said gate into said housing, and a third position intermediate said first and said second positions, the selected position of the gate being a function of the rate of supply of melt to said chamber.

* * * * *